US007882788B2

(12) United States Patent
Sorenson

(10) Patent No.: US 7,882,788 B2
(45) Date of Patent: Feb. 8, 2011

(54) RAIL SYSTEM FOR SPHERICAL OBJECTS

(76) Inventor: Carl Sorenson, 17 E. 89th St., Apt. 10B, New York, NY (US) 10128

( * ) Notice: Subject to any disclaimer, the term of this patent is extended or adjusted under 35 U.S.C. 154(b) by 272 days.

(21) Appl. No.: 12/243,412

(22) Filed: Oct. 1, 2008

(65) Prior Publication Data

US 2009/0084863 A1 Apr. 2, 2009

Related U.S. Application Data

(60) Provisional application No. 60/997,112, filed on Oct. 1, 2007.

(51) Int. Cl.
*A63G 1/00* (2006.01)

(52) U.S. Cl. ..... 104/53; 104/55; 104/123; 446/168; 446/476; 446/3; 238/10 R; 238/10 E

(58) Field of Classification Search ..... 446/168, 446/476, 3; 238/122, 10 R, 10 E; 104/53, 104/55, 123
See application file for complete search history.

(56) References Cited

U.S. PATENT DOCUMENTS 2,574,067 A * 11/1951 Seidman ..... 238/10 R
3,132,441 A * 5/1964 Mahovsky ..... 446/170
3,496,669 A * 2/1970 Siggelkow ..... 446/108
3,587,190 A * 6/1971 Ashton ..... 446/168
4,171,090 A * 10/1979 Eisenburg ..... 238/10 R
4,319,425 A * 3/1982 Shine ..... 446/168
5,800,240 A * 9/1998 Jackson ..... 446/171
5,908,343 A * 6/1999 Rothbarth et al. ..... 446/171
5,924,907 A * 7/1999 Tobin ..... 446/168
6,536,763 B1 * 3/2003 Braun ..... 273/118 R
6,945,839 B2 * 9/2005 Quercetti ..... 446/3
6,953,377 B2 * 10/2005 Quercetti ..... 446/168
2007/0209543 A1 * 9/2007 Beaulieu et al. ..... 104/53
2009/0084863 A1 * 4/2009 Sorenson ..... 238/122

OTHER PUBLICATIONS

SpaceWarp 10000, Manufactured by Bandai (Japan), Product information on website: http://www.himeyashop.com/product_info.php/products_id/5790, Dec. 4, 2008.

* cited by examiner

*Primary Examiner*—S. Joseph Morano
*Assistant Examiner*—Jason C Smith
(74) *Attorney, Agent, or Firm*—Arthur M. Reginelli

(57) ABSTRACT

The present invention provide a rail system for transporting spherical objects comprising: a first flexible rail; a second flexible rail; a flexible spine; and a connector attached to said first flexible rail, said second flexible rail, and said flexible spine. The connector allows for the track to be easily adjusted, while providing rigidity to hold the flexible rails and spline into position during use.

17 Claims, 4 Drawing Sheets

RAIL SYSTEM FOR SPHERICAL OBJECTS

This invention claims priority from U.S. Provisional Patent Application Ser. No. 60/997,112, filed Oct. 1, 2007, which is incorporated herein by reference.

FIELD OF THE INVENTION

Embodiments of the present invention relate to a rail system for spherical objects, such as a metal ball bearing. Embodiments of the present invention provide the ability to easily adjust slope, bank, and height, after track assembly.

BACKGROUND OF THE INVENTION

A track way provided for a spherical object that is variable in relationship to its course is already known. For example, U.S. Pat. No. 3,587,190 teaches a toy having a flexible track having two rails that are connected by a detachable medium positioned between the rails. A ball moves along the rails rather than the medium connecting the rails.

U.S. Pat. No. 4,171,090 teaches a twin-rail trackway for a trackborne toy including a baseplate that has a multiplicity of holes or receptacles to allow supports of varying heights to be inserted for providing support for the rail structure. The twin-rail trackway is supported by a bearing positioned between two vertical rods that are height-adjustable as well as vertically and horizontally pivotable.

U.S. Pat. No. 4,319,425 teaches a gravity operated track applying two hoses that are abutted together and a series of holders, which mount to stakes. The stakes can either be driven into the ground or positioned on bases.

SUMMARY OF THE INVENTION

One or more embodiments of the present invention provide a rail system for transporting spherical objects comprising: a first flexible rail; a second flexible rail; a flexible spine; and a connector attached to said first flexible rail, said second flexible rail, and said flexible spine.

DETAILED DESCRIPTION OF ILLUSTRATIVE EMBODIMENTS

Figure 1:
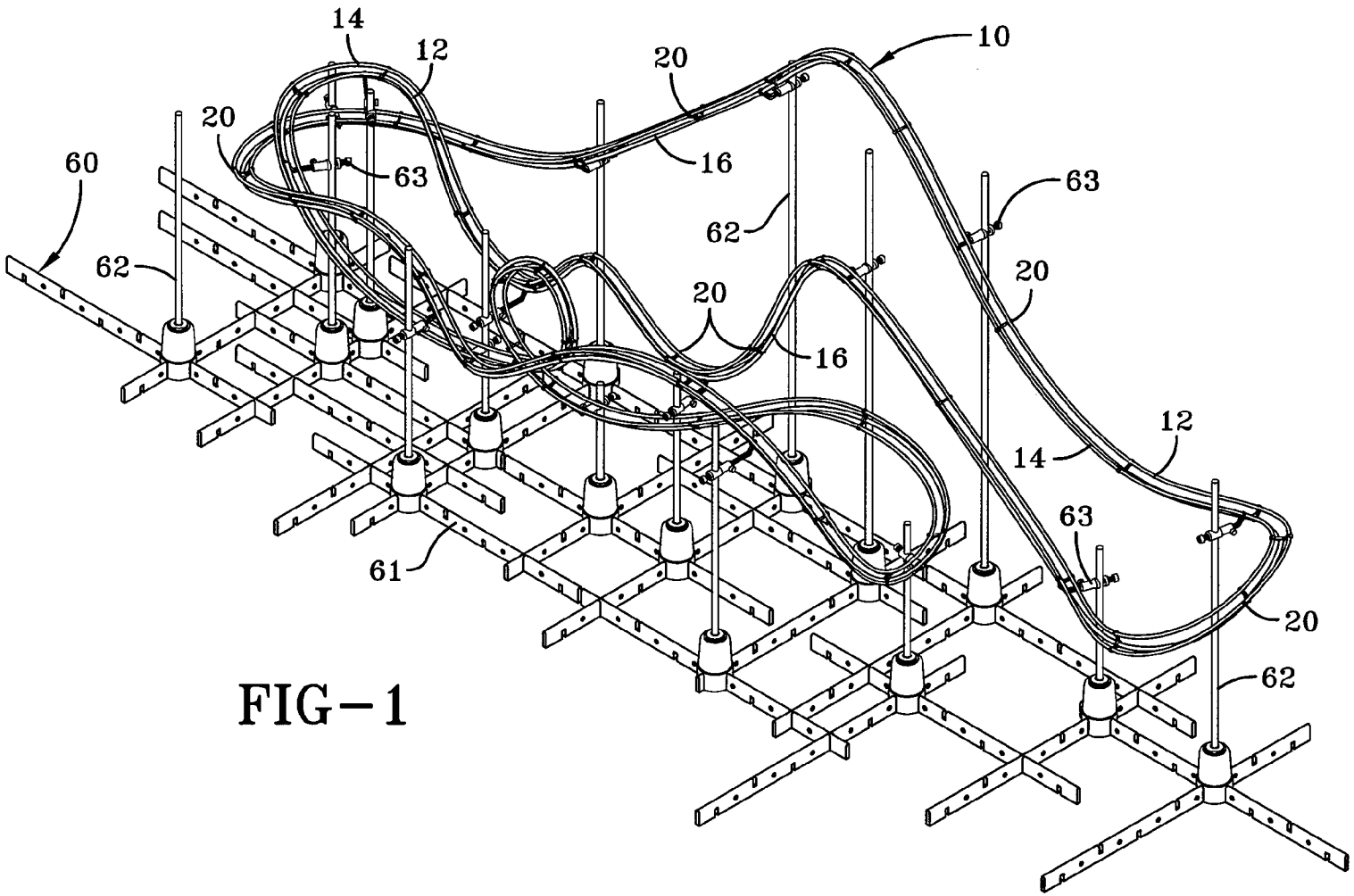
FIG. 1 is a perspective view of a toy track roller coaster for spherical objects according to one or more embodiments of the present invention.
Figure 2:
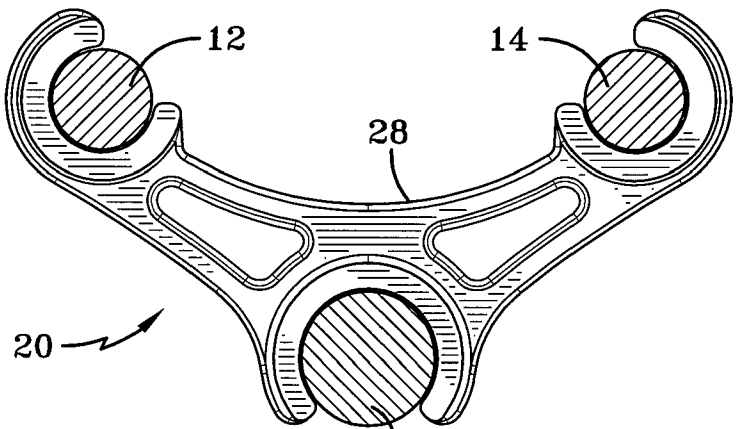
FIG. 2 is a front elevation view of an exemplary connector spacing and joining a spine and a pair of rails.

As shown in FIG. 1, a rail system 10, according to one or more embodiments of the present invention, includes first rail 12 and second rail 14, which together provide a pathway for a spherical object 11, such as a marble, to traverse the rails 12, 14. In other words, and as shown in FIG. 2, spherical object 11 can be supported by rails 12 and 14, and because the positioning of rails 12 and 14, with respect to each other, is substantially maintained throughout the length rail system 10, support is provided to object 11 throughout rail system 10, thereby providing a pathway for object 11 to traverse rail system 10. The rails 12, 14 are flexible, which allows for manipulation of the pathway and ultimately travel of the spherical object 11. The rail system 10 also includes a spine 16, which may advantageously provide support to the rail system 10.

Figure 3:
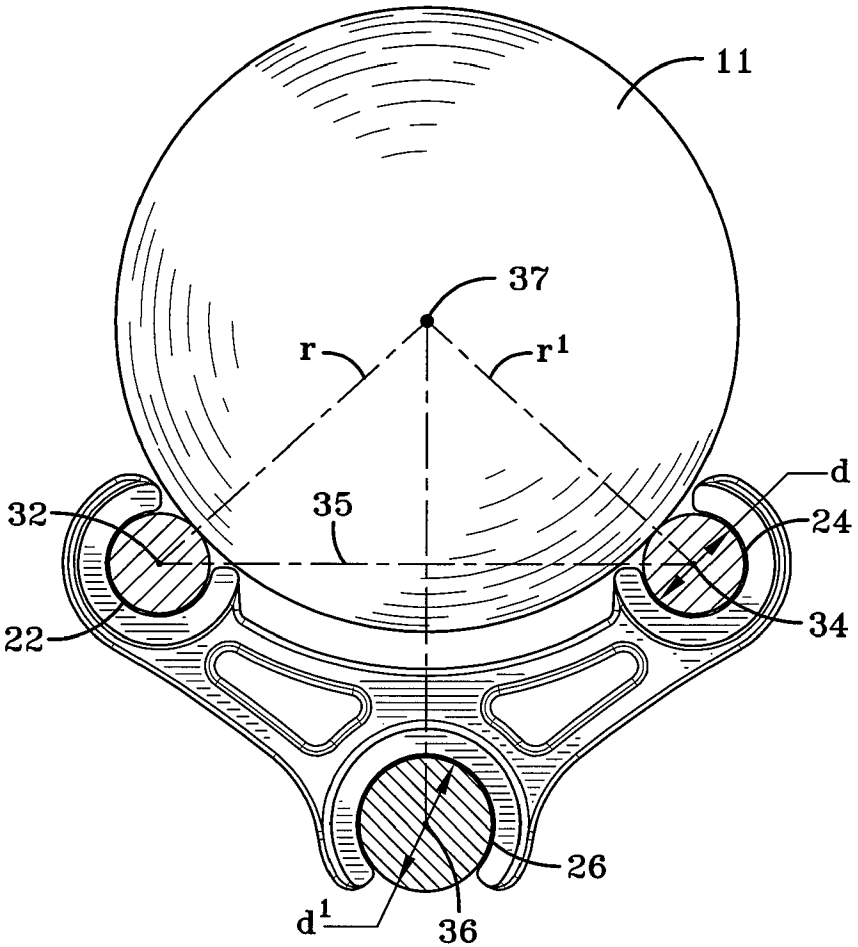
FIG. 3 is a front elevation view of the connector of FIG. 2 including a spherical object shown in traveling relation thereto.
Figure 5:
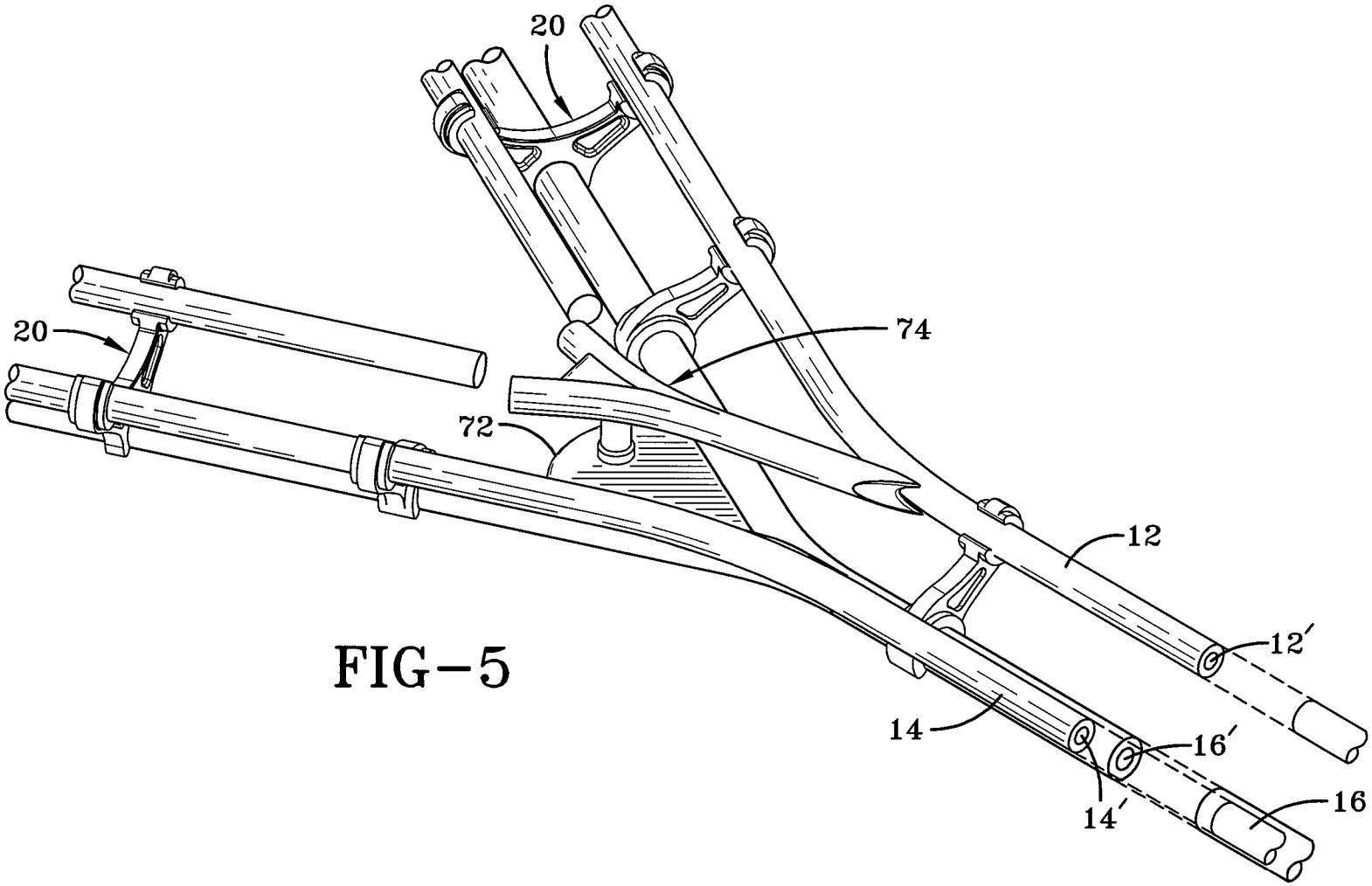
FIG. 5 is a perspective view of a track selector of one or more embodiments of the present invention.

In one or more embodiments, first flexible rail 12 and second flexible rail 14 are substantially similar. In one or more embodiments, rails 12 and 14 are cylindrical and may be defined by an outer diameter d, as shown in FIG. 3. In particular embodiments, rails 12 and 14 are tubular and thus may additionally have inner surface 12' and 14' as seen in FIG. 5. In the case of a tubular configuration, the distance between the outer diameter and the inner diameter may be referred to as the thickness of the tubular wall. Spine 16 may likewise be cylindrical and may be defined by an outer diameter d' as shown in FIG. 3. Tubular spine 16 may likewise have an inner surface $\mathbf{16}^1$ as seen in FIG. 5.

In one or more embodiments, the configuration and composition from which the rails and/or spine are fabricated may provide advantages to the present invention. For example, the mechanical and dynamic properties of the material employed to fabricate the spine and rails may provide flexibility, which among other things allows for manipulation of the pathway. On the other hand, the mechanical and dynamic properties of the composition employed to fabricate the spine and rails may be selected to provide sufficient strength and rigidity to maintain the integrity of the pathway. Likewise, the configuration of the spine and rails may likewise be selected to provide desired flexibility and integrity. In one or more embodiments, the strength of spine 16, such as may be measured by the force required to bend the spine, is greater than the strength of the rails (i.e., force required to bend the rails). In particular embodiments, the rails are tubular and fabricated from nylon 11. In these or other embodiments, the spine is tubular and fabricated from olefinic thermoplastics such as polyethylene, polypropylene, copolymers of ethylene, and propylene or blends thereof.

Figure 4:
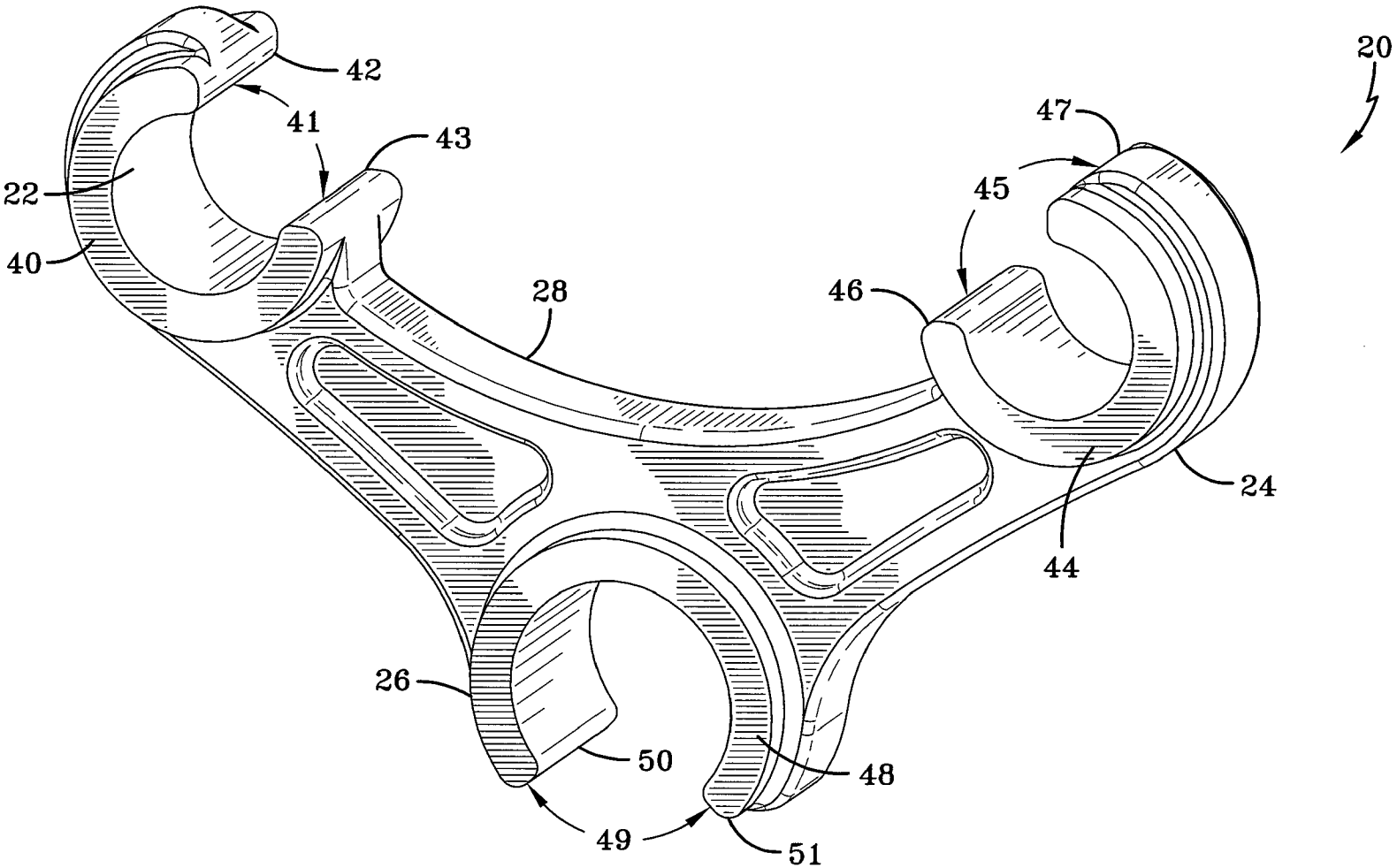
FIG. 4 is a perspective view of the connector of FIGS. 2 and 3 showing additional structural details thereof.

Also, in one or more embodiments, the outer diameter of spine 16 (*d'*) is greater than the outer diameter of the rails 12, 14 (*d*), as seen in FIGS. 2-4. In particular embodiments, the outer diameter of spine 16 (*d'*) is at least 110%, in other embodiments at least 120%, and in other embodiments at least 140% of the outer diameter of the rails 12, 14 (*d*). In these or other embodiments, the thickness of the tubular wall of spine 16 is greater than the thickness of the tubular walls of the rails 12, 14. In one or more embodiments, the thickness of the tubular wall of spine 16 is at least 110%, in other embodiments at least 120%, and in other embodiments at least 140% of the thickness of the tubular walls of the rails 12, 14.

As shown in FIG. 2, the positioning of rails 12 and 14 with respect to each other is maintained by a connector 20. In one or more embodiments, connector 20 maintains rails 12 and 14 at substantially equal spacing throughout their extent. As shown in FIGS. 3 and 4, connector 20 includes a first rail sleeve 22, a second rail sleeve 24, and a spine sleeve 26. Sleeves 22, 24, and 26 are connected to each other through a body 28, which may be rigid and thereby fix the position of the sleeves with respect to each other.

As best shown in FIG. 3, each sleeve may be described with reference to an axis, including axis 32 of first rail sleeve 22, axis 34 of second rail sleeve 24, and axis 36 of spine sleeve 26. In one or more embodiments, axes 32, 34, and 36 are parallel to one another. Axis 32 and axis 34 may define a plane 35 that is offset from spine sleeve axis 36.

In one or more embodiments, sleeves 22, 24, and 26 are substantially circular and include a substantially circumferential (or at least a portion of a circle) body and an opening between circumferential extremities. For example, as can be seen in FIG. 4, first rail sleeve 22 includes circumferential body 40 and opening 41 between first circumferential extremity 42 and second circumferential extremity 43; second rail sleeve 24 includes circumferential body 44 and opening 45 between first circumferential extremity 46 and second circumferential extremity 47; and spine sleeve 26 includes circumferential body 48 and opening 49 between first circumferential extremity 50 and second circumferential extremity 51. In one or more embodiments, the openings 41, 45, 49 of the respective sleeves open radially thereby allowing the sleeves to receive the rails or spine with which the sleeve engages and secures.

With reference again to FIG. 4, the size of the openings 41, 45, 49 of the respective sleeves 22, 24, 26, the size of which may be defined as the distance between the circumferential extremities (e.g., between 42 and 43, or between 46 and 47, or between 50 and 51) may vary. In one or more embodiments, the size of the opening is less than the outer diameter of the rail or spine which the sleeve engages and secures. For example, the size of opening 41 of first rail sleeve 22 is less than the outer diameter of first rail 22; the size of opening 45 of second rail sleeve 24 is less than the outer diameter of second rail 24; and the size of opening 49 of spine sleeve 26 is less than the outer diameter of spine 26.

As shown in FIG. 3, the size of the openings 41, 45 of the first and second rail sleeves 22, 24 is large enough, particularly when engaged with rails 12 and 14, respectively, to allow a spherical object traversing first and second rails 12, 14 to pass without engaging connector 20. Likewise, the positioning of the openings 41, 45 of the rail sleeves 22, 24 are oriented so that a spherical object traversing the rails 12, 14 can pass without engaging the connector 20. In these or other embodiments, the openings 41, 45 include a radius extending between the axes 32, 34 of their respective sleeves 22, 24 and a point 37 located within the center of a spherical object 11 traversing the rails 12, 14 proximate to the connector. These radii are shown as r and r' in FIG. 3. In particular embodiments, the openings 41, 45 of the rail sleeves 22, 24 are circumferentially centered upon radii r, r' extending between axes 32, 34 and a point 37 located within the center of a spherical object 11 traversing the flexible rails 12, 14 proximate to connector 20.

In these or other embodiments, opening 49 of spine sleeve 26 generally extends downward as seen in FIGS. 2 and 3 away from a plane defined between the axes 32, 34 of rail sleeves 22, 24. In other embodiments, opening 49 of spine sleeve 26 may be offset, or in other embodiments may be positioned parallel to a plane defined between the axes 32, 34 of rail sleeves 22, 24.

In one or more embodiments, the sleeves 22, 24, 26 are adapted to receive and removably secure rails 12, 14 or spine 16, respectively. For example, first rail sleeve 22 is adapted to receive and secure (i.e., partially enclose) first flexible rail 12, second rail sleeve 24 is adapted to receive and secure second flexible rail 14, and spine sleeve 26 is adapted to receive and secure spine 16. While the sleeves 22, 24, 26 substantially fix the rails and/or spine in space, the rails 12, 14 and spine 16 remain rotatable within the sleeves 22, 24, 26. In other words, the sleeves 22, 24, 26 secure the rails 12, 14 and spine 16, respectively, while permitting independent rotation of the rails 12, 14 and spine 16, around their respective axes 32, 34, 36 relative to connector 20 and sleeves 22, 24, 26.

In one or more embodiments, the rotatability of the rails and spine within the sleeve varies between the rails 12, 14 and spine 16. In other words, the degree to which or the freedom of rotation of the rails 12, 14 and spine 16, within their respective sleeves, varies. In particular embodiments, rails 12 and 14 may rotate more freely within sleeves 22 and 24, respectively, relative to the freedom with which spine 16 can rotate within sleeve 26. The rotatability, or freedom to rotate, within the sleeves can be varied in several respects. For example, the material from which the rails and/or spine is fabricated may offer differing frictional characteristics relative to the sleeves. Or, the size of the sleeves relative to the outer diameter of the rails or spine may impact the rotatability of the rails or spine within the sleeves.

The combination of rails, connectors, and spine uniquely provides for an advantageous track and pathway for a spherical object as seen in FIG. 1. Those skilled in the art will be able to construct numerous pathways and architectures for a spherical object 11 to traverse. As should be apparent, the flexibility of the rails and spine allows for manipulation of the architecture in both the horizontal and vertical directions. And, the interrelationship of the connector, spine and rails facilitates effective travel of the spherical ball. For example, banked curves and turns can be easily designed and constructed into the rail system.

Those skilled in the art will be able construct numerous support structures to fix, or temporarily fix, the rail system in a desired spatial relation. For example, the rail system 10 can be temporarily or adjustably affixed to a support structure 60 as shown in FIG. 1. Support structure 60 can include a horizontal grid structure 61 and vertical supports 62. In one embodiment, spine 16 is routed to the desired position and attached to support structure 60 through connection element 63, which is in turn connected to vertical support 62 as shown in FIG. 1. This configuration advantageously allows for adjustments to be easily made to the support structure 60 to produce a desired pathway. Connectors 20 may advantageously be removed or added in order to control travel of the spherical object 11 along the pathway of the rail system 10.

The rail system 10 allows a versatile assembly including any length tubing for rails 12, 14 and spine 16. It should be apparent that the pathway distance can be shortened by cutting rails 12, 14 and spine 16. Also, it should be apparent that the pathway distance can be increased by employing longer lengths of rail and spine. Also, where the rails and spine are tubular, connectors such as dowel pins (not shown), can be used to attach lengths of tubing together and effectively extend the length of the rails or spine. The rail system 10 can be a continuous pathway, or may include breaks, optional track selectors, and other features that would be readily known or apparent to those skilled in the art. For example, a switch or track selector 72, such as shown in FIG. 5, can be included in rail system 10. Track selector 72 can attach at three points to three respective spines and at 6 points to 3 respective pairs of rails. Track selector 72 includes a movable top-piece 74 that allows a spherical object 11 to change direction based on the position of the moveable top-piece 74.

After preliminary assembly is complete, the track can be tested and modified to achieve desired characteristics of spherical object 11 travel. Below are a few examples of modifications. Rotating the connector 20 about axes (32, 34, 36) can provide bank to increase or decrease velocity of the spherical object 11. Other adjustments can easily be made by changing the vertical and/or horizontal positions of the rail system 10 with respect to a support structure.

Various modifications and alterations that do not depart from the scope and spirit of this invention will become apparent to those skilled in the art. This invention is not to be unduly limited to the illustrative embodiments set forth herein.

What is claimed is:

1. A rail system for transporting spherical objects comprising:

(i) a first flexible rail;

(ii) a second flexible rail;

(iii) a flexible spine; and (iv) a connector attached to said first flexible rail, said second flexible rail, and said flexible spine, where said connector includes a first rail sleeve, a second rail sleeve, and a spine sleeve interconnected in fixed spaced relation, and where said first rail sleeve, said second rail sleeve, and said spine sleeve each include an axis, and where said first rail sleeve axis, said second rail sleeve axis, and said spine sleeve axis are mutually parallel to one another.

2. The rail system of claim 1, where the first flexible rail is rotatably positioned within said first rail sleeve of said connector, where said second flexible rail is rotatably positioned with in said second rail sleeve of said connector, and where said spine is rotatably positioned within said spine sleeve of said connector.

3. The rail system of claim 1, where said first rail sleeve axis and said second rail sleeve axis form a rail plane, and where said rail plane is offset from said spine sleeve axis.

4. The rail system of claim 1, where said first rail sleeve is substantially circular and includes an opening between two circumferential extremities.

5. The rail system of claim 4, where said second rail sleeve is substantially circular and includes an opening between two circumferential extremities.

6. The rail system of claim 5, where said spine sleeve is substantially circular and includes an opening between two circumferential extremities.

7. The rail system of claim 6, where said first flexible rail is tubular and includes a circular cross section having an outer diameter, and where the length of the opening between the circumferential extremities is less than the diameter of said first flexible rail.

8. The rail system of claim 6, where said second flexible rail is tubular and includes a circular cross section having an outer diameter, and where the length of the opening between the circumferential extremities is less than the diameter of said second flexible rail.

9. The rail system of claim 6, where said flexible spine sleeve is tubular and includes a circular cross section having an outer diameter, and where the length of the opening between the circumferential extremities is less than the diameter of said flexible spine.

10. The rail system of claim 6, where the length of the opening between the circumferential extremities of said first and second rail sleeves is large enough to allow a spherical object traversing the first and second flexible rails to pass without engaging said connector.

11. The rail system of claim 6, where the opening within said first rail sleeve and said second rail sleeve are oriented toward a radius extending between the axis of the sleeves and a point located within the center of a spherical object traversing the flexible rails proximate to the connector.

12. The rail system of claim 6, where the opening within said first rail sleeve and said second rail sleeve is circumferentially centered upon a radius extending between the axis of the sleeves and a point located within the center of a spherical object traversing the flexible rails proximate to the connector.

13. The rail system of claim 6, where the connector is removably attached to said first flexible rail, said second flexible rail, and said flexible spine.

14. The rail system of claim 1, where said first flexible rail is tubular and includes a circular cross section, and where said first rail sleeve is shaped to radially receive and secure said first flexible rail while permitting rotation of the rail.

15. The rail system of claim 14, where said second flexible rail is tubular and includes a circular cross section, and where said second rail sleeve is shaped to radially receive and secure said second flexible rail while permitting rotation of the rail.

16. The rail system of claim 15, where said flexible spine is tubular and includes a circular cross section, and where said spine sleeve is shaped to radially receive and rotatably secure said flexible spine while permitting rotation of the spine.

17. A rail system for transporting spherical objects comprising:

(i) a first flexible rail;

(ii) a second flexible rail;

(iii) a flexible spine; and (iv) a connector attached to said first flexible rail, said second flexible rail, and said flexible spine, where said connector includes a first rail sleeve, a second rail sleeve, and a spine sleeve interconnected in fixed spaced relation, where said first rail sleeve is substantially circular and includes an opening between two circumferential extremities, where said second rail sleeve is substantially circular and includes an opening between two circumferential extremities, where said spine sleeve is substantially circular and includes an opening between two circumferential extremities, and where said flexible spine sleeve is tubular and includes a circular cross section having an outer diameter, and where the length of the opening between the circumferential extremities is less than the diameter of said flexible spine.

* * * * *